United States Patent [19]

Albetski

[11] Patent Number: 5,038,968

[45] Date of Patent: Aug. 13, 1991

[54] MEDICATION DEBLISTERING APPARATUS AND METHOD

[76] Inventor: Donald N. Albetski, 14 Carriage Dr., Enfield, Conn. 06082

[21] Appl. No.: 607,919

[22] Filed: Nov. 1, 1990

[51] Int. Cl.[5] ..... B65G 1/16

[52] U.S. Cl. ..... 221/1; 221/25; 221/88; 206/531

[58] Field of Search ..... 221/25-26, 221/69, 87-89, 191, 194-195, 197, 208, 287, 289, 302, 312 R, 312 C, 1; 206/531

[56] References Cited

U.S. PATENT DOCUMENTS

| | | | |
|---|---|---|---|
| 1,575,972 | 3/1926 | Cochran . | |
| 2,217,681 | 10/1940 | Jennings et al. . | |
| 2,366,886 | 1/1945 | Van Tuyl . | |
| 2,957,604 | 10/1960 | Goldman et al. . | |
| 3,263,840 | 8/1966 | Peters . | |
| 3,279,651 | 10/1966 | Thompson . | |
| 3,340,789 | 9/1967 | Simjian | 221/25 |
| 3,651,927 | 3/1972 | Richardson et al. | 221/5 |
| 4,074,806 | 2/1978 | Ardito . | |
| 4,298,125 | 11/1981 | Berghahn et al. | 206/531 |
| 4,817,819 | 4/1989 | Kelly | 221/89 |
| 4,909,414 | 3/1990 | Heath | 221/25 |
| 4,975,015 | 12/1990 | Harding | 221/25 |

OTHER PUBLICATIONS

Literature on "MTS Crusher/Deblistermachine", by Medical Technology Systems, Inc. of Clearwater, FL.

*Primary Examiner*—David H. Bollinger
*Assistant Examiner*—Steven Kennemore

[57] ABSTRACT

Apparatus for removing medication units from a card dispenser comprising a card on which medication units are secured in pockets formed in a flexible sheet material disposed in the card and sealed by a rupturable covering element thereof, has a base member upon which the card dispenser is supported. The base member has a body portion with a series of elongated channels in its upper surface defined by parallel extending ribs. A roller with a handle is rotatably rolled along the upper surface of the card dispenser while bridging the channels to press downwardly the medication units and cause the rupturable covering element to be severed and the medication units to drop into the channels.

14 Claims, 3 Drawing Sheets

FIG. 1
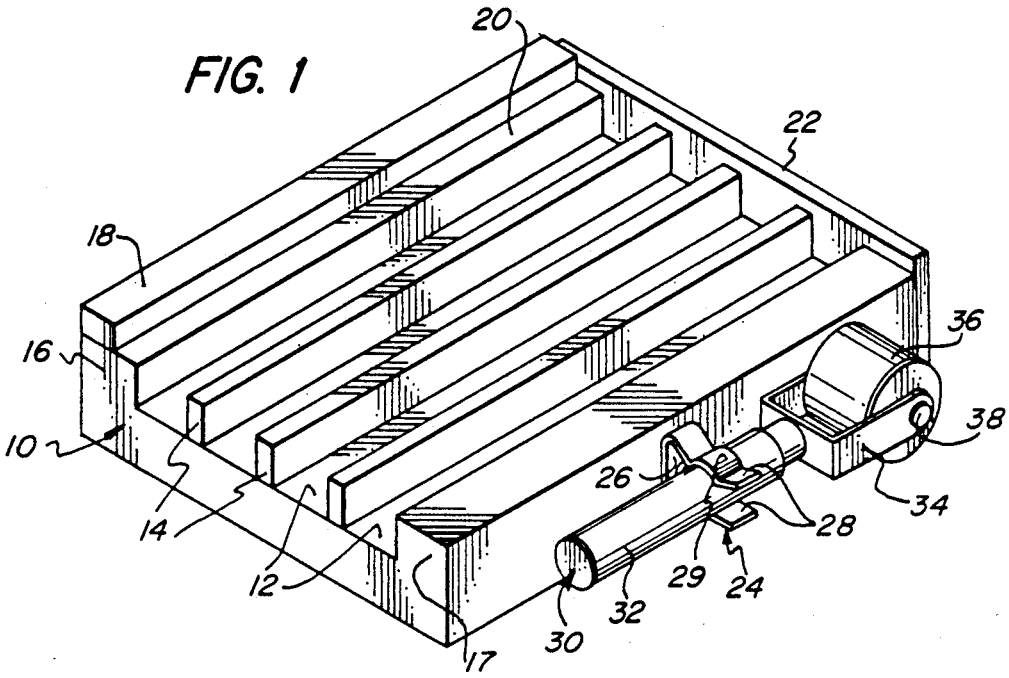
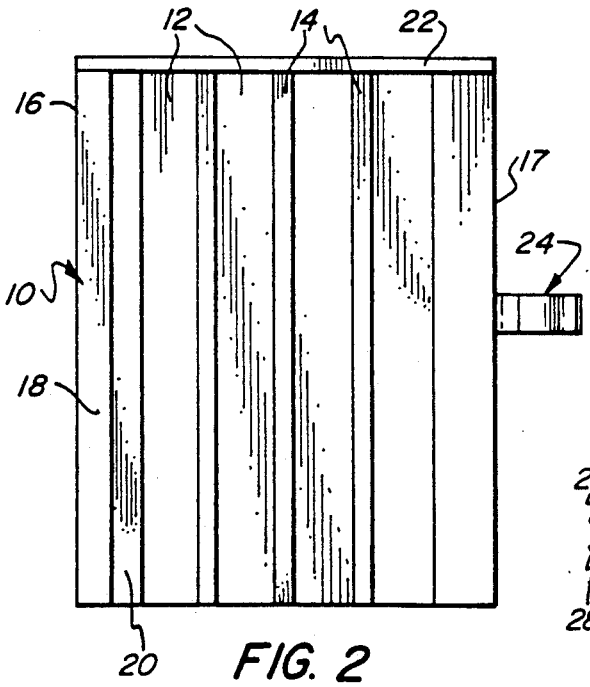
FIG. 2
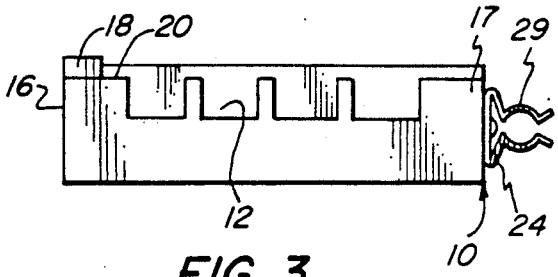
FIG. 3
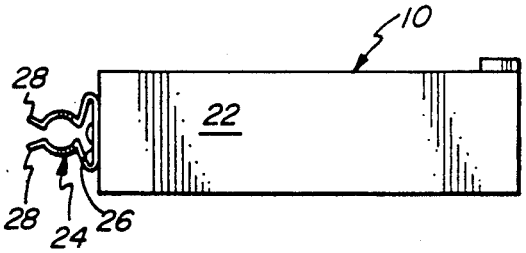
FIG. 4

MEDICATION DEBLISTERING APPARATUS AND METHOD

BACKGROUND OF THE INVENTION

The present invention relates to medication dispensing and more particularly, to apparatus and methods for removing medication units from card dispensers therefor.

It is a relatively common practice at the present time for pharmacies to place a supply of medication units such as capsules or pills in pockets of a dispenser card from which they may be removed as required by tearing or breaking a covering sheet material. Such card dispensers also permit ready counting of the units by the pharmacy and by the users.

In some instances, the card dispenser will be the supply of such medication for a single patient for a period of time, or it may comprise a supply to be used for several patients for a lesser period of time. The use of such card dispensers is fairly common in the instance of nursing homes and the like which rely upon an outside pharmacist to provide the medication for various patients, and the name or names of the patients may be printed upon the card. At the facility, a registered nurse or practical nurse will remove the medication units from the pockets of the card dispenser as required by breaking the covering material.

In the event that an unused or partially used dispenser card is no longer needed due to discharge, death or transfer of the patient or due to a change in medication, it is customary to remove the medication from the card and destroy it. In some states where regulations permit, the removed medication may be used for other patients requiring such medication.

Apparatus has been developed which uses a platen with projections thereon, and the platen is moved downwardly against the pockets containing the medication units to break the pockets in which they are sealed so as to release them. However, such apparatus is relatively large and costly, and generally requires that all of the medication units be removed from the card dispenser at the same time.

It is an object of the present invention to provide a novel apparatus for removing in a simple manner all or only some of the medication units from a card dispenser.

It is also an object to provide such apparatus in which the medication units may be removed from the pockets in which they are seated without substantial injury thereto.

Another object is to provide such an apparatus which may be fabricated relatively economically, which is relatively light weight, and which is adapted to a range of sizes of card dispensers.

Still another object is to provide a novel method for removing medication units from such card dispensers, which method is simple and effective and which may be employed to remove only a limited number of the medication units from the card dispenser.

SUMMARY OF THE INVENTION

It has now been found that the foregoing and related objects may be readily attained in an apparatus for removing medication units from a card dispenser comprising a card with a multiplicity of apertures therein arranged in a multiplicity of columns and rows, a pocket forming sheet of flexible sheet material providing pockets extending outwardly of the card, medication units in the pockets, and a rupturable covering sheet material closing the pockets to seal the medication units therein. The apparatus includes a base member having a body portion with a series of elongated channels in its upper surface defined by parallel extending ribs, and the base member is dimensioned cooperatively with respect to the associated card dispenser.

Cooperating with the base member is a roller member with a handle rotatably mounting at one end thereof a roller dimensioned axially to bridge the channels. When a card dispenser is placed upon the upper surface of the base member with the columns of pockets and medication units disposed in the channels, the roller may be rolled along the upper surface of the card dispenser while bridging the channels to press downwardly the pockets and medication units and cause the covering sheet material to be severed and the medication units to drop into the channels.

Preferably, the upper surface of the base member has an upstanding flange along one side thereof extending above the plane of the upper ends of the ribs to provide a stop for positioning the card dispenser. Desirably, the upper surface of the base member also has a second upstanding flange along a second side thereof extending perpendicular to the first flange thus providing stops for positioning two sides of the associated card dispenser.

In the preferred embodiments, the base member is formed from synthetic resin. The base member also has the lower surface of the body portion configured to provide a series of elongated channels defined by a series of parallel extending ribs, and the width of the channels on the lower surface is different from that of the channels on the upper surface. The lower surface of the base member has depending flanges of greater height than the ribs in the lower surface to provide stops for positioning a card dispenser having columns of cooperating spacing.

The base member desirably has mounting means thereon for releasably retaining the roller member thereon.

In use of the apparatus to remove medication units from a card dispenser, the card dispenser is placed on the base member with the pockets projecting upwardly from the card, and with the pockets and medication units disposed above the channels. A roller member bridging the channels is pressed downwardly against and rolled over the pockets and medication units to cause the covering sheet material to be severed and the medication units to drop into the channels.

BRIEF DESCRIPTION OF THE DRAWINGS

FIG. 1 is perspective view of a pill deblistering apparatus embodying the present invention;

FIG. 2 is a top plan view thereof with the roller removed;

FIG. 3 is a front end elevational view thereof;

FIG. 4 is a rear end elevational view thereof;

DETAILED DESCRIPTION OF PREFERRED EMBODIMENT OF THE INVENTION

Figure 5:
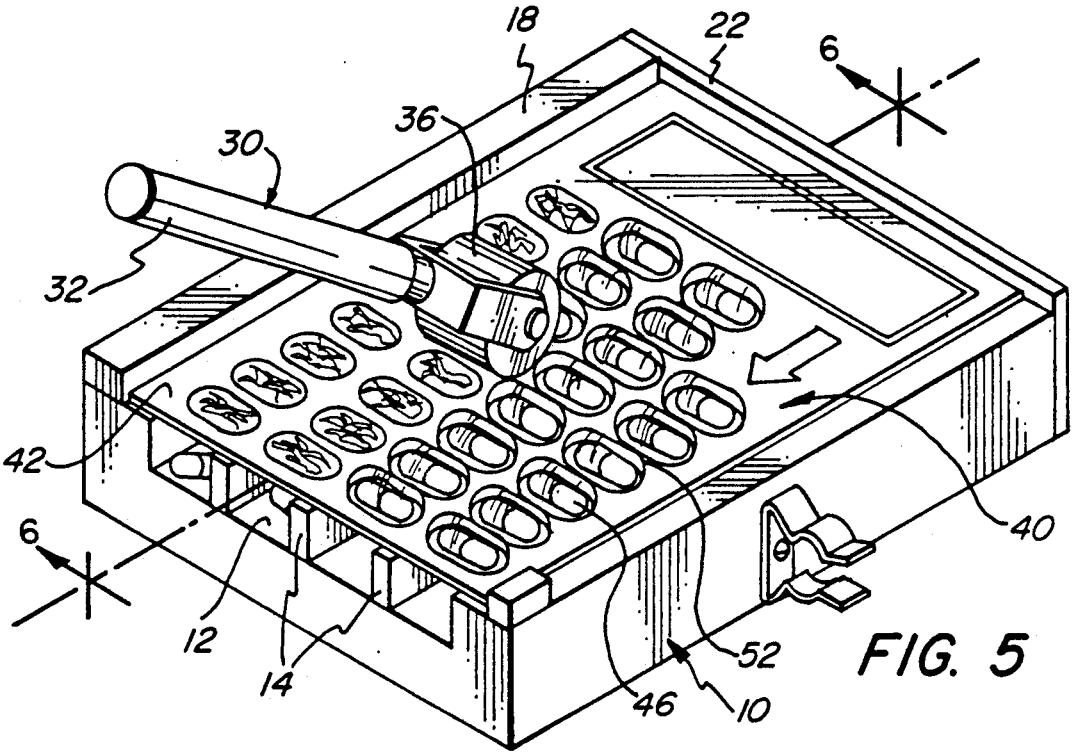
FIG. 5 is a perspective view of the base member with a card dispenser placed thereon and with the roller shown as having broken the pockets of one column and being advanced along the pockets of a second column.

Turning first to the embodiment of FIGS. 1-4, therein illustrated is apparatus embodying the present invention for use with a dispenser card for tablets or capsules having a first range of spacing between adjacent columns. The base member generally designated by the numeral 10 has a series of parallel extending channels 12 in its upper surface with upstanding ribs 14 therebetween and parallel extending side blocks 16, 17 of greater thickness. One of the blocks 16 has a parallel extending stop 18 spaced outwardly from its inner edge to leave a planar support surface 20 in the same plane as the top surface of the ribs 14 and of the other side block 17. Along one end of the base member 10 is an end plate 22 which extends above the plane of the ribs 14 and closes the end of the channels 12.

On one side wall of the base member 10 is secured a generally U-shaped mounting bracket generally designated by the numeral 24 and having a base portion 26 secured to the base member 10 and a pair of vertically spaced spring arms 28. The spring arms 28 are configured to provide opposed arcuate portions 29 in which is releasably secured the roller member generally designated by the numeral 30.

The roller member 30 has an elongated cylindrical handle 32 with a bifurcated mounting element 34 at one end, and a relatively large diameter roller 36 is rotatably mounted between the arms of the element 34 on a shaft 38 extending therebetween.

Figure 6:
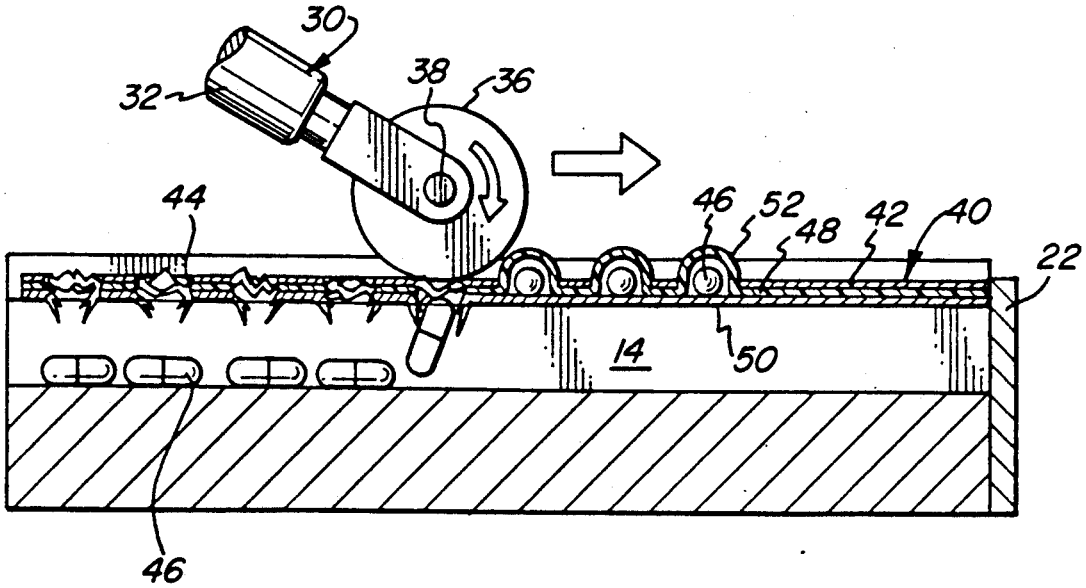
FIG. 6 is a fragmentary sectional view along the line 6—6 of FIG. 5 and drawn to an enlarged scale.
Figure 7:
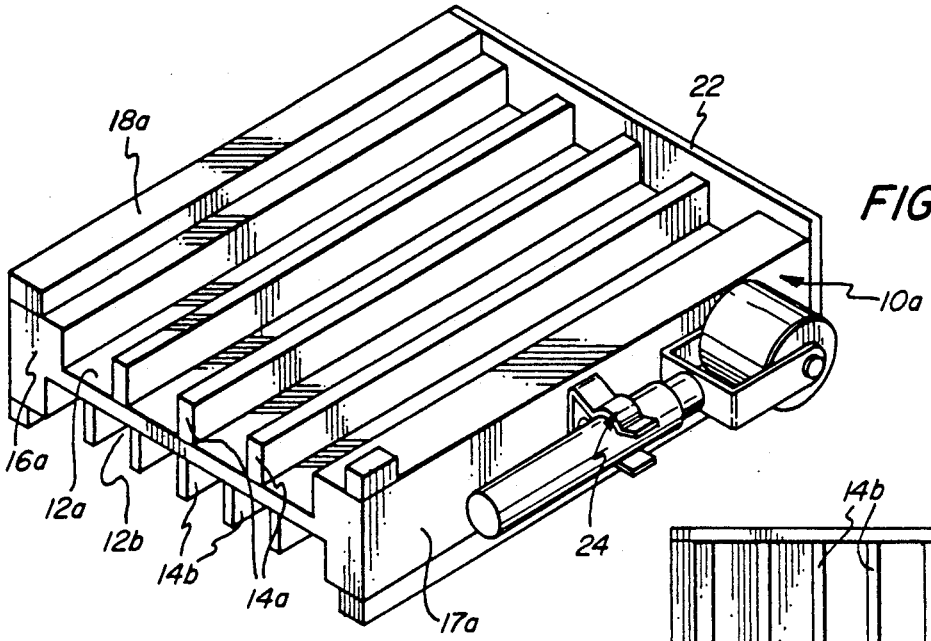
FIG. 7 is a perspective view of another embodiment of base member having two different sizes of channels, one on the top surface thereof, and the other on the bottom surface thereof.
Figure 10:
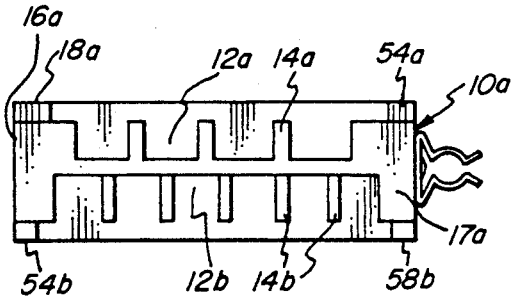
FIG. 10 is an end elevational view thereof.
Figure 9:
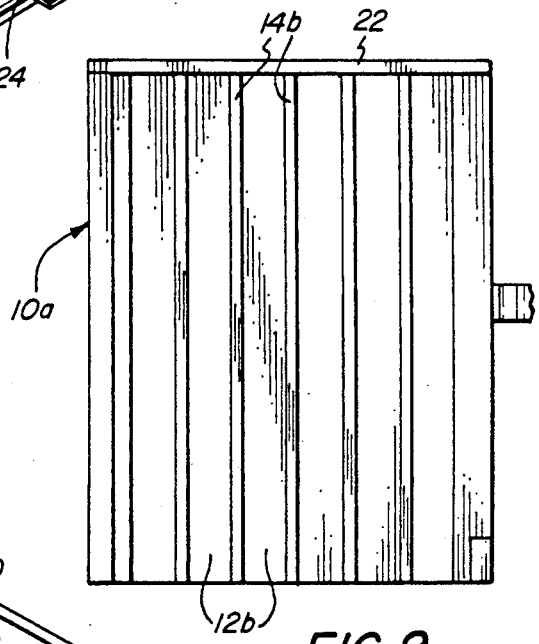
FIG. 9 is a fragmentary plan view thereof.
Figure 8:
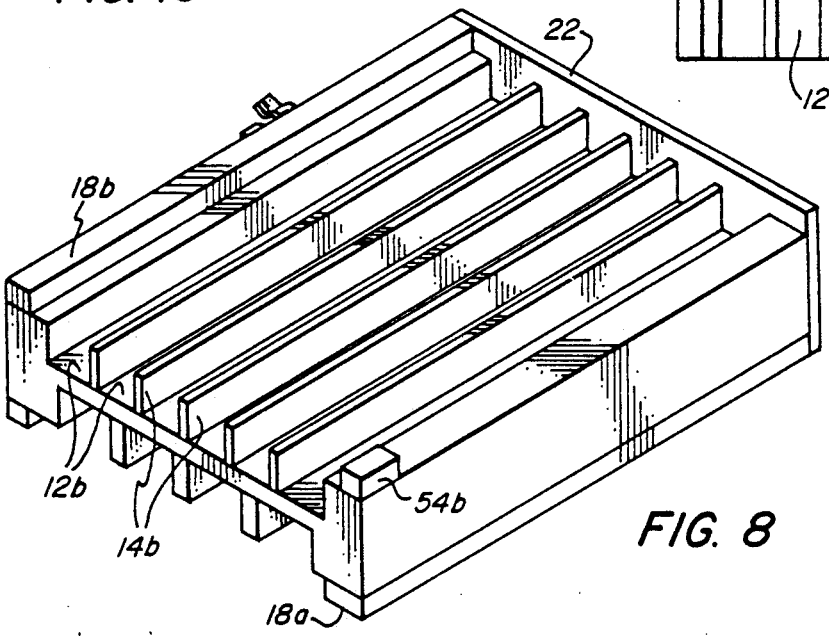
FIG. 8 is a perspective view of the base unit turned over.

Turning now to FIGS. 5 and 6, a card dispenser generally designated by the numeral 40 has been placed on the base member 10 with two of its edges abutting the stop 18 and end plate 22 so that it seats on the ribs 14, the planar surface 20 of the block 16, and the block 17. The card dispenser 40 includes a folded card 42 of paperboard or the like with a multiplicity of apertures 44 therein arranged in parallel rows and columns. A synthetic resin sheeting 48 is formed with blisters or pockets 52 which extend above the upper surface of the card 42, and medication units 46 such as capsules are secured within the pockets 52 by a rupturable covering sheeting 50. The sheeting 48, 50 is bonded to the card 42.

As can be seen in FIG. 6, the pockets 52 and medication units 46 project above the plane of the card 42. The dimensioning of the base member 10 cooperates with the card dispenser 40 so that the columns of medication units 46 are disposed in the channels 12, and the axial length of the roller 36 is such that it bridges the channels 12.

When the roller member 30 is pressed downwardly on pockets 52 on the upper surface of the card dispenser 40 and is rolled therealong, it pushes the medication units 46 downwardly against the covering sheeting 50, causing it to rupture as seen in FIG. 6. The capsules 46 then drop downwardly into the channels 14 and onto the base surface thereof. To collect the medication units 46, the base member 10 may be tilted to cause them to slide outwardly of the open end of the channels 12, or they may be lifted from channels 12 of the base member 10 as needed.

Turning now to the embodiment of FIGS. 7-10, therein illustrated is a base member **10*a* which is adapted for use with card dispensers having a variety of column spacing. In this embodiment, the base member 10*a* is formed with channels 12*a* in its upper surface which are of a first width and channels 12*b* in its lower surface which are of a greater width. The ribs 14*a* are of greater width than the ribs 14*b*. To provide stable seating, the surface of the end plate 22 is coplanar with the surfaces of the stops 18*a*, 18*b*, and a stabilizer block 54*a*, 54*b* is provided at the outside corners of the top and bottom surfaces of the side block 17**.

Depending upon the size of the card dispenser, and more particularly, the spacing between columns of pockets in the card dispenser, the appropriate surface of the base member will be employed and the card placed thereon.

For convenience of illustration, the ribs and stops and end plate have been shown as separate elements in the first embodiment, but the entire structure of the base member can be integrally formed by injection or compression molding of synthetic resin, or the basic structure may be extruded from synthetic resin and other elements adhesively or otherwise secured thereto to provide the final structure. Moreover, it is possible to fabricate the base member so that the transverse wall between the side plates has a multiplicity of spaced T-slots therein and to fabricate the ribs with cooperating T-shaped base formations thereon to provide disengageable but rigid mounting thereof. As a result, the ribs can be moved into different slots to vary the spacing between the ribs and thereby the width of the channels in which the pockets are disposed.

The roller may have a variety of configurations, but it is desirable that the roller element be of relatively large diameter and of an axial length sufficient to bridge the width of the channels provided within the base member. If so desired, the material from which the roller element is fabricated may provide a limited degree of resilient deflection so as to minimize the tendency to crush the medication within the pockets as the roller initially begins to bear thereupon.

The deblistering apparatus of the present invention may be utilized to remove all of the medication units from the card assembly, or only a single column thereof. In fact, only a portion of a column may be deblistered by the controlled action of the roller. Unlike platen deblistering apparatus arrangements, the limited rolling action enables the user to limit the rupturing of the pockets to only the number of medication units which are required at any given time and yet to proceed efficiently and rapidly in doing so.

Although the preferred structures are fabricated the base member from synthetic resin, other materials may be employed including metals, wood and ceramics. It is desirable, however, that the surface of the channels in the base member be smooth so that they may be readily cleaned and sterilized to avoid contamination of the medication units which will fall thereinto. Accordingly, synthetic resins providing a sufficient degree of temperature resistance to permit sterilization are preferred.

Thus, it can be seen from the foregoing detailed specification and attached drawings, that the pill deblistering apparatus of the present invention is on which may be fabricated readily and economically, and which is operable quick)y and easily. The operator may use the roller to completely remove all the medication units from the card dispenser, or only a limited number therefrom. The assembly enables rupturing of the sealing elements for the pockets to remove the medication units without substantially damaging the units themselves during the process. The deblistering apparatus may be fabricated from materials which are economical and which are easy to keep clean and sterile to avoid contamination of the medication units.

Having thus described the invention, what is claimed is:

1. Apparatus for removing medication units from a card dispenser comprising a card with a multiplicity of apertures therein arranged in a multiplicity of columns and rows, a pocket forming sheet of flexible sheet material providing pockets extending outwardly of the card, medication units in the pockets, and a rupturable covering sheet material closing the pockets to seal the medication units therein, said apparatus comprising:

(a) a base member having a body portion with a series of elongated channels in its upper surface defined by parallel extending ribs, said base member and channels being dimensioned cooperatively with respect to the associated card dispenser; and (b) a roller member comprising a handle rotatably mounting at one end thereof a roller dimensioned axially to bridge said channels, whereby, when a card dispenser is placed upon said upper surface of said base member with the columns of pockets and medication units disposed in said channels, the roller may be rolled along the upper surface of the card dispenser while bridging said channels to press downwardly the pockets and medication units and cause said covering sheet material to be severed and the medication units to drop into said channels.

2. The medication removing apparatus of claim 1 wherein the upper surface of said base member has an upstanding flange along one side thereof extending above the plane of the upper ends of said ribs providing a stop for positioning the associated card dispenser.

3. The medication removing apparatus of claim 2 wherein the upper surface of said base member has a second upstanding flange along a second side thereof extending perpendicular to said first flange, thereby providing a pair of stops for positioning two sides of the associated card dispenser.

4. The medication removing apparatus of claim 1 wherein said base member is formed from synthetic resin.

5. The medication removing apparatus of claim 1 wherein said base member has a lower surface of said body portion configured to provide a series of elongated channels defined by a series of parallel extending ribs, the width of said channels on said lower surface being different from that of said channels on said upper surface.

6. The medication removing apparatus of claim 5 wherein said lower surface of said base member has depending flanges of greater height than said ribs in said lower surface to provide stops for positioning thereon a card dispenser having columns of a cooperating width.

7. The medication removing apparatus of claim 1 wherein said base member has mounting means thereon for releasably retaining said roller member thereon.

8. Apparatus for removing medication units from a card dispenser comprising a card with a multiplicity of apertures therein arranged in a multiplicity of columns and rows, a pocket forming sheet of flexible sheet material providing pockets extending outwardly of the card, medication units in the pockets, and a rupturable covering sheet material closing the pockets to seal the medication units therein, said apparatus comprising:

(a) a base member having a body portion with a series of elongated channels in its upper surface defined by parallel extending ribs, a lower surface of said body portion being configured to provide a series of elongated channels defined by a series of parallel extending ribs, the width of said channels on said lower surface being different from that of said channels on said upper surface, said base member and channels being dimensioned cooperatively with respect to associated card dispensers, the upper and lower surfaces of said base member having flanges along one side thereof extending respectively above and below the upper and lower ends of said ribs to provide stops for positioning an associated card dispenser; and (b) a roller member comprising a handle rotatably mounting at one end thereof a roller dimensioned axially to bridge said channels, whereby, when a card dispenser is placed upon either of said surfaces of said base member with the columns of pockets and medication units disposed in said channels and said pockets projecting upwardly, the roller may be rolled along the upper surface of the card dispenser while bridging said channels to press downwardly the pockets and the medication units and cause said covering sheet material to be severed and the medication units to drop into said channels.

9. The medication removing apparatus of claim 8 wherein the upper and lower surfaces of said base member have second upstanding flanges along second sides thereof extending perpendicularly to said first flanges, thereby providing a pair of stops for positioning two sides of associated card dispensers.

10. The medication removing apparatus of claim 8 wherein said base member is formed from synthetic resin.

11. The medication removing apparatus of claim 8 wherein said base member has mounting means thereon for releasably retaining said roller thereon.

12. The method for removing medication units from a card dispenser comprising the steps of:

(a) providing a base member having a body portion with a series of elongated channels in its upper surface defined by parallel extending ribs;

(b) placing on said base member a medication dispenser card comprising a multiplicity of apertures therein arranged in a multiplicity of columns and rows, a pocket forming sheet of flexible sheet material providing pockets extending outwardly of said card, medication units in said pockets, and a rupturable covering sheet material closing said pockets to seal said medication units therein, said pockets projecting upwardly from said card, said base member and channels being dimensioned cooperatively with respect to the columns in said card dispenser and said pockets and medication units being disposed above said channels; and (c) pressing against the rolling over the upper surface of said card dispenser a roller member bridging said channels to press downwardly said pockets and medication units and cause said covering sheet material to be severed and the medication units to drop into said channels.

13. The medication removing method of claim 12 wherein the upper surface of said base member has an upstanding flange along one side thereof extending above the plane of the upper ends of said ribs, said card dispenser being positioned against said flange to provide a stop orienting said card dispenser over said channels.

14. The medication removing method of claim 13 wherein the upper surface of said base member has a second upstanding flange along a second side thereof extending perpendicularly to said first flange, two sides of said card dispenser being positioned against both flanges.

* * * * *